US012672689B2

(12) United States Patent
Sukohardjo et al.

(10) Patent No.: US 12,672,689 B2
(45) Date of Patent: Jul. 7, 2026

(54) EXPANDABLE FOOTWEAR

(71) Applicant: Sno Gro, LLC, Glenview, IL (US)

(72) Inventors: Callista Sukohardjo, Rancho Dominguez, CA (US); Benjamin James Miller, Tigard, OR (US); Joan Park, Glenview, IL (US)

(73) Assignee: SNO GRO, LLC, Glenview, IL (US)

( * ) Notice: Subject to any disclaimer, the term of this patent is extended or adjusted under 35 U.S.C. 154(b) by 0 days.

(21) Appl. No.: 18/816,276

(22) Filed: Aug. 27, 2024

(65) Prior Publication Data

US 2025/0000198 A1 Jan. 2, 2025

Related U.S. Application Data

(60) Provisional application No. 63/524,656, filed on Jul. 1, 2023.

(51) Int. Cl.
*A43B 3/26* (2006.01)
*A43B 13/14* (2006.01)

(52) U.S. Cl.
CPC ..... *A43B 3/26* (2013.01); *A43B 13/14* (2013.01)

(58) Field of Classification Search
None
See application file for complete search history.

(56) References Cited

U.S. PATENT DOCUMENTS 2,490,916 A 12/1949 Miller
3,997,985 A * 12/1976 Shiina ..... A43B 3/26 36/97
5,513,881 A * 5/1996 DiMeglio ..... A63C 3/12 280/825
5,699,629 A 12/1997 Munschy
7,032,327 B1 4/2006 Tartaglia et al.
7,055,268 B2 * 6/2006 Ha ..... A43B 1/0018 36/97
7,137,212 B2 * 11/2006 Miller ..... A43B 3/36 36/97

(Continued)

FOREIGN PATENT DOCUMENTS

CA 2201816 A1 10/1998
CN 203328072 U 12/2013

(Continued)

*Primary Examiner* — Jila M Mohandesi
(74) *Attorney, Agent, or Firm* — John L. DeAngelis; Wolter Van Dyke; Davis, PLLC

(57) ABSTRACT

A size expandable footwear. The footwear comprises an outsole affixed to a bottom surface of a lower segment, which features a mechanism that allows for size adjustment and locking at various desired lengths (sizes) of the footwear. The size adjustment mechanism is comprised of an expandable section integrated within the lower segment, such that it facilitates mechanical expansion in the longitudinal and vertical directions by mechanical and material means. A plurality of capture elements that, when engaged, lock the lower segment at the desired (size/length). The upper and lower segments, the inner lining, and the outsole components are integrated to ensure the footwear remains watertight and thermally insulating during winter conditions. The invention addresses the need for durable, expandable winter footwear, reducing financial and environmental burdens associated with frequently outgrown footwear.

12 Claims, 9 Drawing Sheets

FIG. 5B

(56) References Cited

U.S. PATENT DOCUMENTS

| | | | | |
|---|---|---|---|---|
| 7,204,042 | B2 | 4/2007 | Aveni | |
| 7,246,803 | B2 | 7/2007 | Sauter et al. | |
| 7,540,100 | B2 | 6/2009 | Pawlus et al. | |
| 7,581,337 | B2 * | 9/2009 | Miller | A43B 3/26 36/97 |
| 7,694,435 | B1 | 4/2010 | Kiser et al. | |
| 8,468,723 | B2 | 6/2013 | Malka-Harari | |
| 8,544,189 | B2 | 10/2013 | Chaney et al. | |
| 8,661,714 | B2 * | 3/2014 | Sussmann | A43B 1/0018 36/97 |
| 8,938,890 | B2 | 1/2015 | Raghuprasad | |
| 9,491,983 | B2 | 11/2016 | Rushbrook | |
| 9,526,295 | B2 | 12/2016 | Malka-Harari | |
| 10,314,365 | B2 | 6/2019 | James et al. | |
| 10,709,200 | B2 | 7/2020 | Nurse et al. | |
| 11,311,077 | B2 | 4/2022 | Pavone et al. | |
| 11,419,371 | B2 | 8/2022 | Nordstrom et al. | |
| 11,445,783 | B2 | 9/2022 | Whiteman et al. | |
| 12,121,106 | B2 * | 10/2024 | Blanche | A43B 11/00 |
| 2005/0204585 | A1 | 9/2005 | Loveridge et al. | |
| 2006/0037215 | A1 | 2/2006 | Lee | |
| 2007/0151123 | A1 * | 7/2007 | Cavasin | A43B 1/0018 36/97 |
| 2008/0222923 | A1 | 9/2008 | Fregoni et al. | |
| 2009/0119952 | A1 | 5/2009 | Chovino et al. | |
| 2010/0230914 | A1 | 9/2010 | Chen | |
| 2011/0094125 | A1 | 4/2011 | Weightman | |
| 2017/0042277 | A1 | 2/2017 | Skrepenski | |
| 2017/0360188 | A1 | 12/2017 | Alguire | |
| 2018/0199659 | A1 | 7/2018 | Lintaman | |
| 2019/0254381 | A1 | 8/2019 | Hopkins et al. | |
| 2022/0273075 | A1 | 9/2022 | MacLeod et al. | |
| 2023/0276893 | A1 | 9/2023 | Mittal | |

FOREIGN PATENT DOCUMENTS

| | | | |
|---|---|---|---|
| CN | 107259709 | B | 7/2020 |
| CN | 211379817 | U | 9/2020 |
| CN | 217885248 | U | 11/2022 |
| EP | 1991077 | B1 | 11/2008 |
| EP | 2789251 | A1 | 10/2014 |
| EP | 3302120 | B1 | 11/2018 |
| EP | 2400935 | B1 | 11/2019 |
| KR | 20130068902 | A | 6/2013 |
| KR | 20150105341 | A | 12/2017 |
| KR | 102208653 | B1 | 1/2021 |
| RU | 2009132545 | A | 3/2011 |
| TW | 1722322 | B | 6/2019 |

* cited by examiner

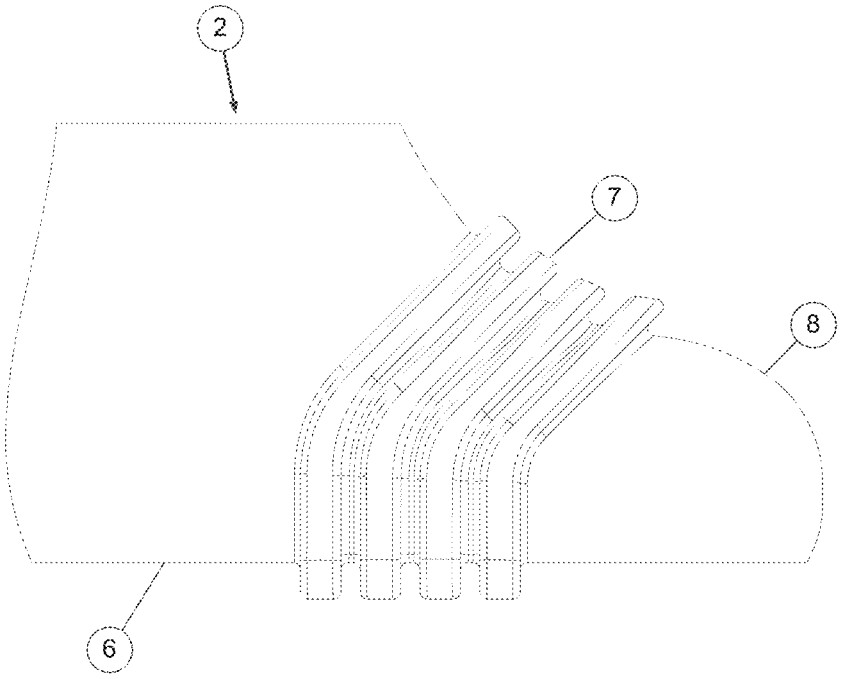
FIG. 3
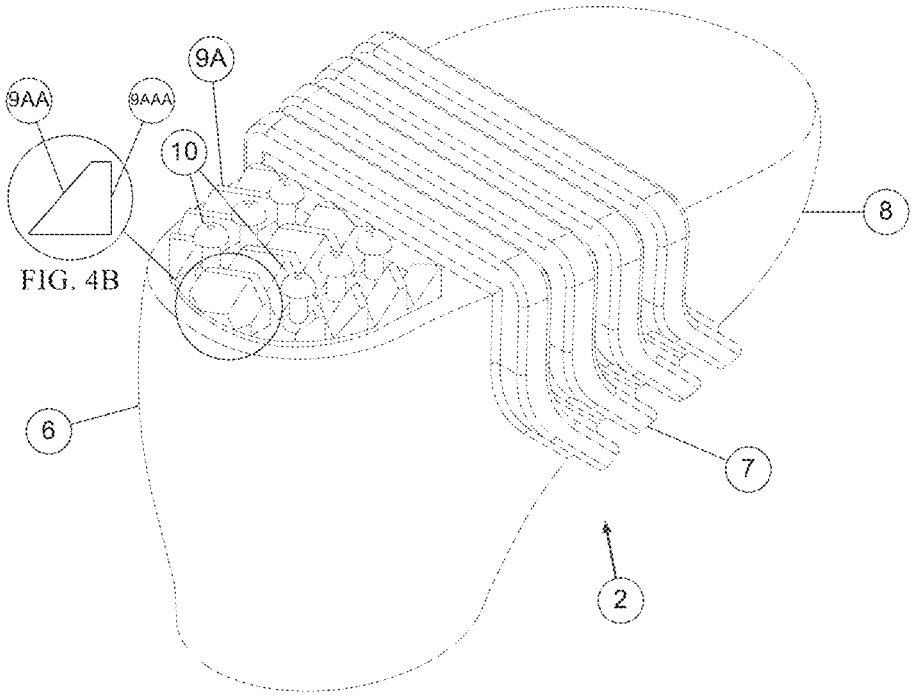
FIG. 4B
FIG. 4A

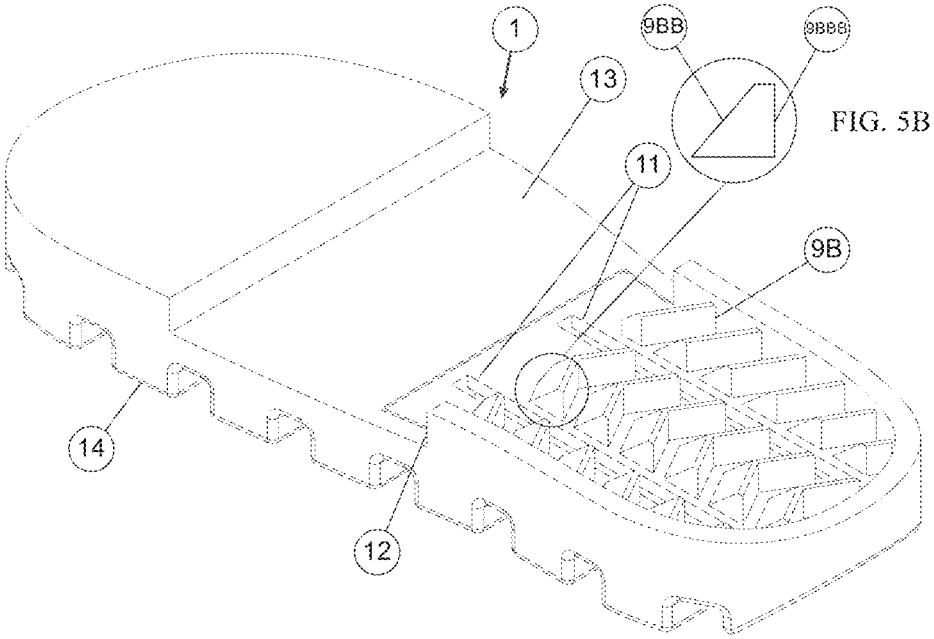
FIG. 5B
FIG. 5A
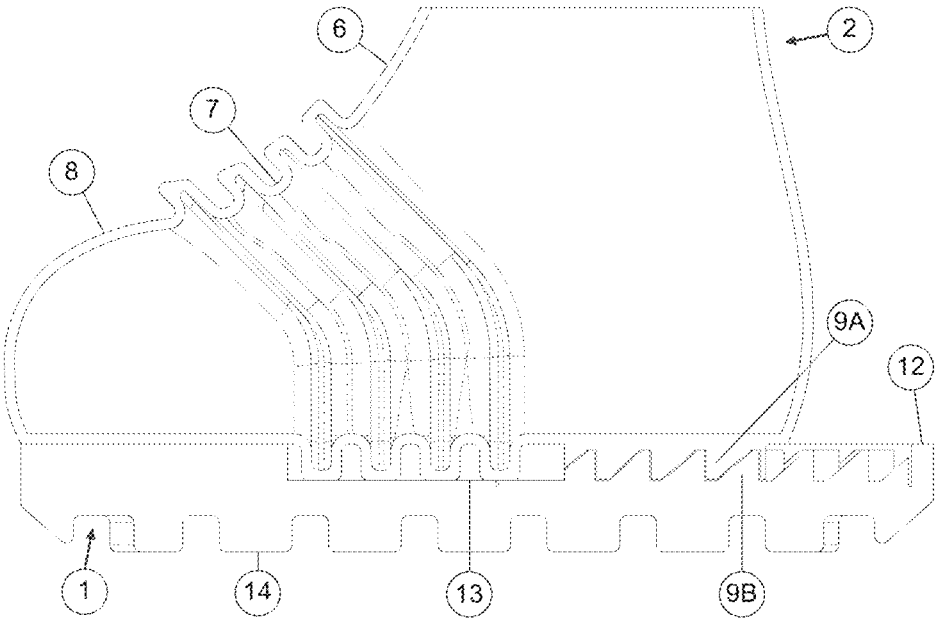
FIG. 6

FIG. 13B
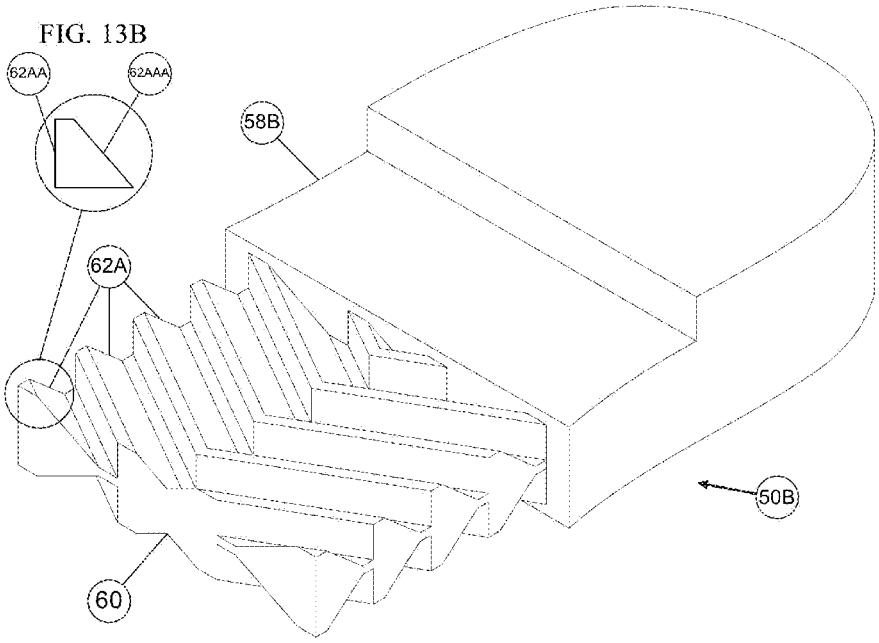
FIG. 13A
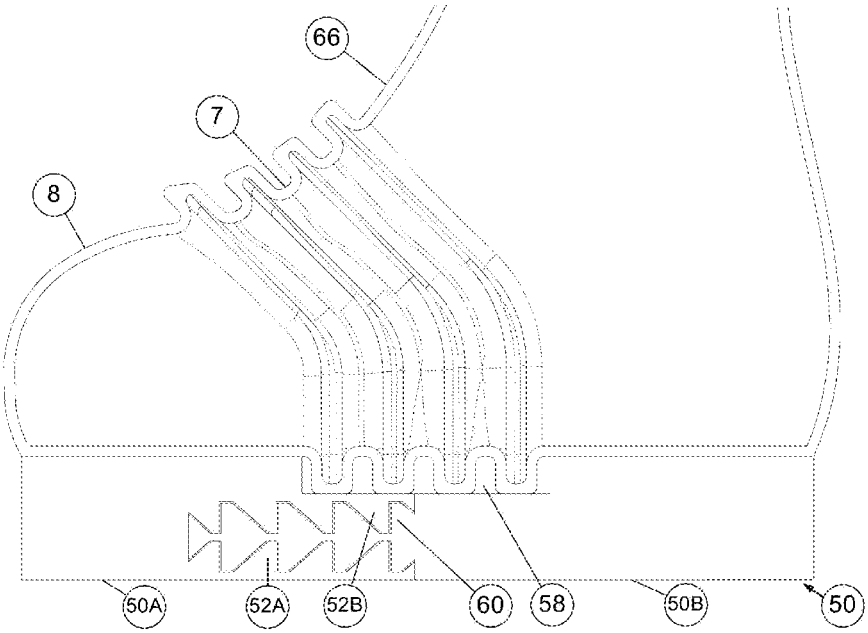
FIG. 14

EXPANDABLE FOOTWEAR

CROSS REFERENCE TO RELATED APPLICATIONS

The present invention claims priority under 35 U.S.C. 119(e) to the provisional patent application filed on Jul. 1, 2023 and assigned application No. 63/524,656. This provisional patent application is incorporated in its entirety herein.

BACKGROUND OF THE INVENTION

Children often outgrow footwear due to their rapid foot growth, and the need to continually acquire additional footwear in larger sizes can create financial and environmental burdens on households with growing children.

Currently, the main solutions for addressing the perpetual need for larger footwear are purchasing new footwear, which can be costly on a household depending on the child's rate of growth as well as the number of children at home, or finding ways to reuse existing footwear.

Footwear that has been outgrown can be handed down, recycled at a recycling center, or donated to a second-hand store, thereby decreasing the amount of shoe waste. However, if not sized properly, children may end up wearing existing footwear that is too small, risking damage to the foot and discomfort, or acquiring larger, potentially ill-fitting footwear that they must utilize until they grow into its larger size. Additionally, matching second-hand footwear with children who need them is a difficult process and donations may end up in landfills due to lack of demand, contributing to the environmental strain that the overconsumption of footwear creates.

An alternative solution to this issue is the various technologies currently embodying size-adjustable footwear. They include shoes, sandals, rollerblades, and ski boots that can adjust or expand to accommodate various foot sizes. These footwear options expand using a variety of mechanisms for expansion, such as stretching fabric, mechanical sliding, and others.

However, the current technologies for growing footwear typically only apply to the leisure and sportswear categories of footwear. They do not address the needs of winter footwear, as the expansion mechanisms do not typically afford things such as thermal retention and water resistance. Seasonal footwear, such as winter boots, contribute a greater amount to the financial and environmental costs of regularly acquiring larger sizes, as they rarely become worn out by the time a growing user's foot becomes too large. While there are products on the market for limited-use sports footwear that can be adjusted in size, such as rollerblades, ice skates, and ski boots, the options only work for footwear requiring rigid support and do not provide the user with the flexibility available with common winter footwear. As such, there are no mechanisms in the field of common winter footwear that accommodate multiple foot sizes.

Disadvantages of presently available size-changeable footwear include limitations of the user's ankle and foot movement or the requirement to use various tools to facilitate adjustment (e.g. ski boots), the inability to keep the user's foot well insulated, protect against colder weather and elements, and poor slip resistance in low friction terrain (e.g. non-winter suitable expandable footwear).

Therefore, what is needed is an article of footwear that can expand to accommodate foot growth while offering comfort and protection from winter conditions.

SUMMARY OF THE INVENTION

The primary objective of the invention comprises a size-expandable footwear that can expand to a plurality of sizes as the user's foot grows over time. The inventive techniques and elements can also be applied to a snow boot for wearing in winter conditions. The invention comprises an outsole (sometimes referred to as a sole) with a mechanism that allows for longitudinal expansion and locking at desired lengths as the wearers' feet grow; a lower component (also referred to as a lower segment) capable of supporting such expansion (and contraction if necessary) in the form of a materially and mechanically expanding section; and an upper component (also referred to as an upper segment) that also accommodates the expansion (and contraction).

Another objective of the invention comprises an expandable, convoluted, and angled structure within the footwear (typically within the lower component of the footwear) to allow for expansion in the vertical and longitudinal directions (that is, heel to toe direction or shoe size) at different rates, according to the growth of a foot, without inducing any upward forces on the toe portion of the footwear.

Another objective of the invention comprises an expansion mechanism or track within the outsole and a complementary mechanism or track within the heel segment of the lower component. In one embodiment, both mechanisms or tracks comprise a herringbone-shaped profile. These mechanisms or tracks allow longitudinal expansion of the lower component and the outsole and they lock into place at the desired longitudinal length. Various expansion mechanisms and capture mechanisms are employed in various embodiments of the invention.

Another objective of the invention integrates interference pins extending downward from a bottom surface of the lower component to engage channels integrated into a top surface of the outsole. These elements form the locking mechanism and allow the bottom outsole and lower component to lock into place after the expansion mechanism has been adjusted to a desired longitudinal length.

Another objective of the invention comprises an expansion mechanism within the outsole that involves two herringbone-shaped tracks integrated into a front (female) component and back (male) component of the outsole that can be fitted together and locked at different locations to provide longitudinal expansion.

Another objective of the invention comprises a front component that utilizes flexible material to allow the front (female) component to be squeezed in the lateral (left-right or shoe width) direction and expand in the vertical direction to allow the back (male) component to be adjusted to the desired longitudinal length and compressed by the front (female) component when released.

Another objective of the invention comprises a front (female) component with a lateral split creating a top and bottom half in the front (female) component. The back (male) component comprises a protrusion that is received within the lateral split. This configuration creates a locking mechanism that locks the front and back components together by compressing the back (male) component within the lateral split in the female component, after the expansion mechanism has been adjusted to the desired longitudinal length.

Another objective of the invention comprises a latch integrated into the bottom half of the front (female) component and pins integrated into the top half of the front (female) component to lock the two halves of the component together when the pins engage the latch.

Another objective of the invention comprises interference pins and holes integrated into the top and bottom halves of the front (female) component to lock the two halves of the component together.

Another objective of the invention comprises the integration of the upper and lower components and the outsole such that the footwear is watertight at the seams and thermally insulating.

Another aspect of the invention relates to a method of manufacturing by injection molding the components. The lower component, containing the expanding bellows, is injection molded as one piece onto the other components including the upper component and lining.

Another embodiment employs molding processes to manufacture the boot as a single element or as separate components. While the lower component can be injection molded, according to other embodiments the lower component is compression molded, dip molded, heat shrink molded, thermoformed, rotocasted, or vacuum molded. Each of these manufacturing processes can be employed to produce the bellows, lower component, outsole, and other boot components as one or as multiple parts. According to the different manufacturing methods, multiple materials may be used for different components of the footwear.

The inventive objectives set forth above can be achieved according to various embodiments of the invention as described herein. Certain embodiments may include one or more objectives and different embodiments may include different objectives.

BRIEF DESCRIPTION OF THE DRAWINGS

FIG. 3 is a side view of the lower component of FIG. 2.

FIGS. 4A and 4B are respectively, an underside view of the lower component of FIG. 2 and a detailed inset view of a region of the lower component.

FIGS. 5A and 5B are respectively, a top view of the outsole of FIG. 1 and a detailed inset view of a region of the outsole.

FIGS. 6 and 7 are side cross-sectional views of the lower component and outsole of FIG. 1, taken along different cross-sectional planes.

FIG. 13A is a perspective detailed view of the back/heel segment of the outsole of FIG. 11 and FIG. 13B is a detailed inset view of a region of the back/heel segment of FIG. 13A.

FIG. 14 is a side cross-section view of the lower component and outsole of FIG. 11.

The present invention is illustrated by way of example and not limitation in the figures of the accompanying drawings in which like reference numerals indicate similar elements.

DETAILED DESCRIPTION OF THE INVENTION

In certain embodiments, the novel footwear comprises a unitary outsole with complimentary alignment and capture mechanisms integrated into the outsole and the lower component of the footwear. The alignment mechanism may comprise complimentary tracks and the capture mechanism may comprise vertical or horizontal pins and corresponding openings to receive the pins.

Other embodiments comprise a split outsole with various alignment and capture mechanisms.

Material selection for the multiple footwear components can also achieve or at least contribute to the objectives of lateral, longitudinal, and vertical expansion.

As used herein, longitudinal refers to the conventional heel-to-toe direction or shoe size. References to lateral are to a left-right direction or shoe width. Vertical references are to a vertical height of the footwear.

Figure 1:
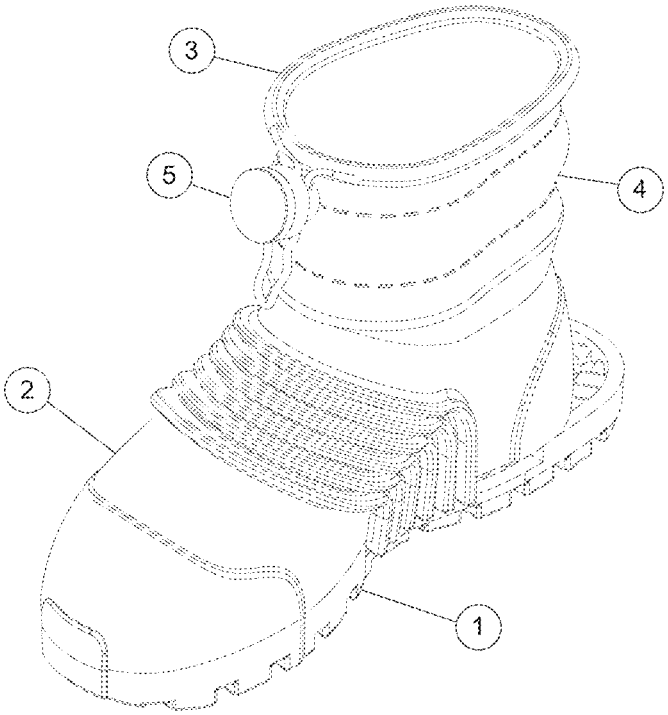
FIG. 1 is an isometric view of an expandable winter boot according to one embodiment of the invention.
Figure 2:
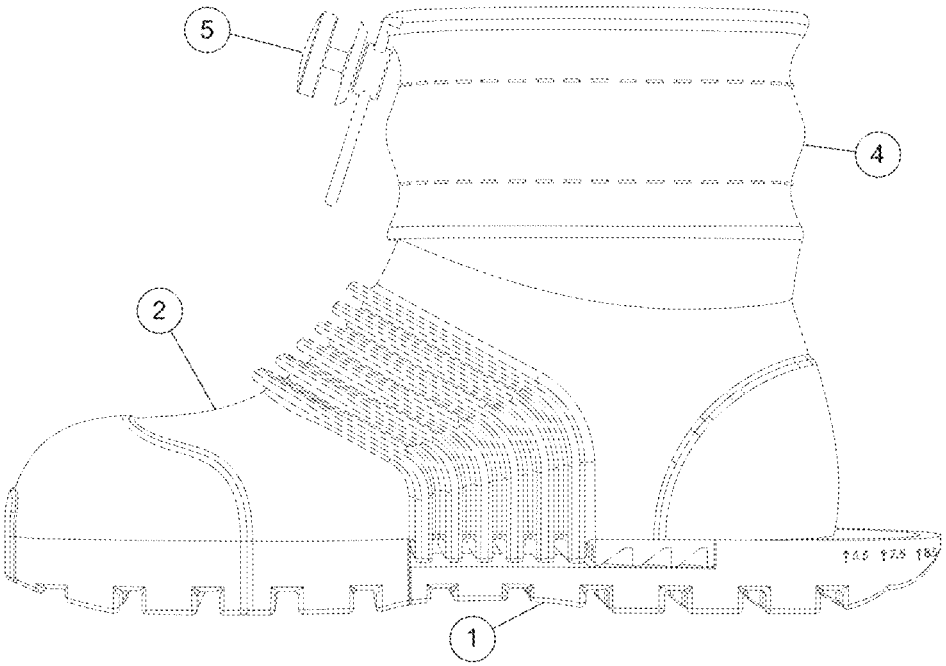
FIG. 2 is a side view of the expandable winter boot in FIG. 1.

A first embodiment of an expandable winter boot is illustrated in FIGS. 1 and 2, comprising an outsole 1, a lower component 2, an inner lining 3, an upper component 4, and an upper tightening mechanism 5, such as a Velcro® brand strap (Velcro® is a registered trademark of Velcro IP Holdings, LLC, Manchester, NH). Another tightening mechanism 5 comprises a bungee cord and a cord lock.

The lower component 2, also illustrated in FIG. 3, comprises the back heel section 6, mid bellows (expandable and contractible) section 7, and front toe section 8. The mid bellows section 7 facilitates mechanical expansion in the longitudinal and vertical directions by expansion of the convoluted and angled structure of the mid bellows section.

The lower component 2 may be made of stretchy, durable, and waterproof material (such as polyurethane or the like) to facilitate material expansion, while protecting the user's foot from exposure to the elements.

The lower component 2 may be manufactured (such as by injection molding, compression molding, dip molding, heat shrink molding, thermoforming, rotocasting, or vacuum molding). The lower component 2 can be constructed as a singular component or as three separate components, i.e., the back heel section 6, the mid bellows section 7, and the front toe section 8, and joined to the inner lining 3 and upper component 4, such as by molding the lower component 2 onto the lining 3 and upper component 4 or with an industrial grade adhesive used at the seams between the various sections.

One embodiment of the lower component 2, illustrated in FIG. 4A, features a track section 9A and vertical interference pins 10, both located on the back heel section 6 of this embodiment of the lower component 2. In one embodiment the pins 10 have a dome or mushroom-shaped head.

The track section 9A and vertical interference pins 10 interface with one embodiment of the outsole 1, illustrated in FIG. 5A, which features a mating track section 9B and channels 11 for receiving the interference pins 10. As illustrated in FIG. 5A, the two channels 11 extend longitudinally (heel-toe direction) and proximate the protrusions in the lower track section 9B. Multiple vertical interference pins 10 within the track section 9A are spaced equidistantly across the length of those channels.

As can be seen in the respective figures, both the lower component track section 9A (FIG. 4A) and the outsole track section 9B (FIG. 5A) have a herringbone (arrow) shaped profile comprising a plurality of triangular prisms (and in other embodiments (not shown), right-angle triangular prisms, rectangles, or triangles can be used in lieu of the triangular prisms).

In track section 9A (of the lower component 2) the flat angled front face 9AA (see FIG. 4B) of each triangular prism points in a direction toward the heel, and the flat vertical face 9AAA is on the toe side of the lower component.

In the track section 9B (of the outsole 1) the flat angled front face 9BB (see FIGS. 5A and 5B) of each triangular prism points in a direction toward the toe, and the flat vertical surface 9BBB is on the heel side of the outsole.

Thus, when the outsole is joined to the lower component, the respective triangular prism tracks 9A and 9B nest to provide front/back (toe/heel) stability for the joined components.

As known by those skilled in the art, other track profiles, in lieu of the herringbone profile, and other track engagement components (in lieu of the triangular prisms, the right angle triangular prisms, and interference pins/channels) can be used in lieu of the profiles and shapes shown and described herein.

Figure 7:
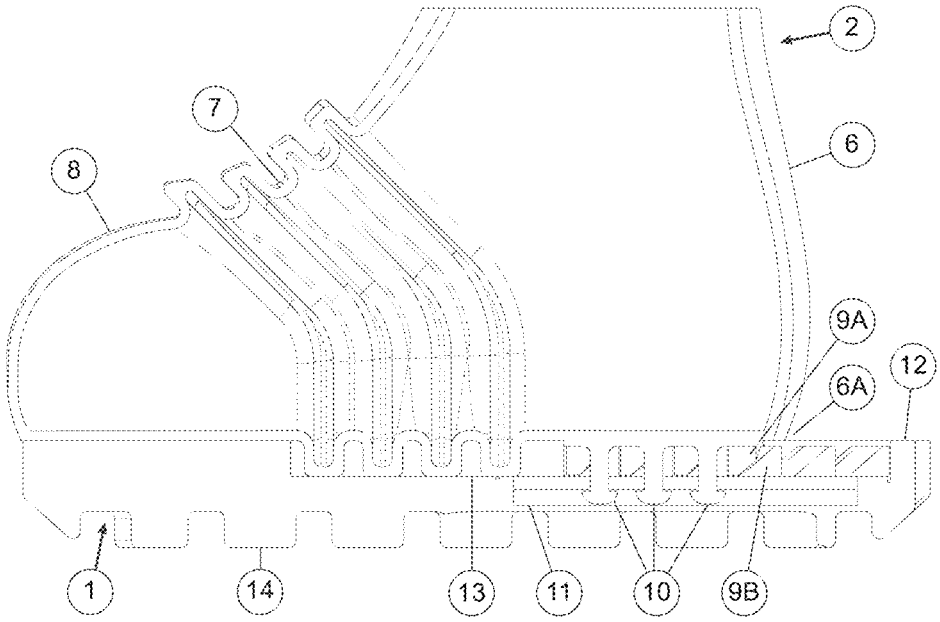

The lower component 2 and the outsole 1 are shown in a mated or joined configuration in FIGS. 6 and 7. Both identified figures are cross-sectional views of the lower component 2 and the outsole 1 taken along different cross-sectional planes.

FIG. 6 is taken along a plane that illustrates the triangular prisms 9A extending downward from the lower segment 2 and the triangular prisms 9B extending upward from the outsole 1.

FIG. 7, illustrating a different cross-sectional view of the mated lower component 2 and the outsole 1 depicts the vertical interference pins 10 received and captured within the channels 11. This arrangement secures the lower component 2 and outsole 1 in the vertical direction. The triangular prism tracks 9A and 9B are also illustrated in FIG. 7.

The prism tracks 9A and 9B aid coupling of the lower component 2 and the outsole 1, but their primary purpose is longitudinal (heel-toe) alignment, whereas the pins 10/channels 11 provide that vertical coupling needed when the child is walking.

The outsole 1 also features a guard 12, illustrated in FIG. 5, encircling the outsole track section 9B to prevent foreign objects or external elements from easily slipping into the outsole track section 9B or into the channels 11 and interfering with their function.

The lower component 2 is joined (such as with an adhesive or via over-molding) to the front toe section of the outsole 1 to keep the two components permanently joined to each other, as illustrated in FIGS. 6 and 7. This feature does not affect the adjustability or stretchability of the length of the footwear to a new size (that is, the adjustability or stretchability of lower component) and, in fact, is required to permit expansion of the bellows section 7 and thus the heel section of the lower component along the outsole 1.

The outsole 1 also features a notch or cutout 13 to prevent the outsole 1 from interfering with the mid bellows section 7 of the lower component 2 when the lower component 2 is mated with the outsole 1. See FIGS. 5, 6, and 7.

Note that to modify the shoe size of the inventive footwear, it is necessary to exert a downward force on the outsole 1 and an upward force on the lower component 2. The combination of these forces unlocks the longitudinal engagement, that is, disengaging the track section 9B (of the outsole 1) from the track section 9A (of the lower component 2). In this configuration, the bellows of the lower component 2 can be expanded (or contracted) to increase the shoe size (or to decrease the shoe size) as desired. Clearly, disengagement of the track sections can also be accomplished by an upward force on the lower component 2.

That downward force also stretches the pins 10. Since the pins are captured within a channel 11, they slide along the channel 11 as the bellows 7 are expanded or contracted. Thus, it is not necessary for the pins 10 to be dislodged from the channel; stretching of the pins is generally sufficient to permit longitudinal movement of the bellows to change the shoe size.

After adjustment to a new shoe size, the lower component 2 is then pushed into place on the outsole 1, until the lower component track section 9A reengages the outsole track section 9B.

If the vertical interference pins 10 are dislodged from the channels 11 when the track sections 9A and 9B are separated, they must be reinserted back into the channels 11 to rigidly couple the lower component 2 and the outsole 1. See FIG. 7.

If the pins 10 were only stretched when the track sections 9A and 9B were disengaged, the pins return to their initial length when the track sections 9A and 9B are reengaged.

The outsole 1 also features a tread pattern 14, as seen on typical boots, to increase slip resistance during use in winter weather. Sec FIGS. 6, 7, and 8.

Figure 8:
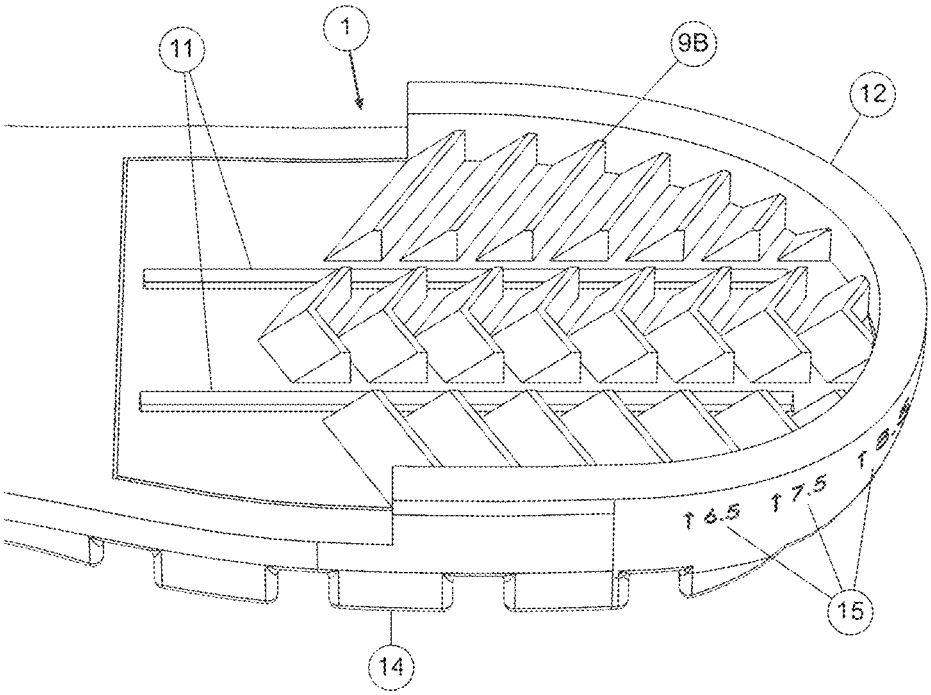
FIG. 8 is a close-up top view of the outsole of FIG. 5.

The outsole 1 also features current-size indicators 15, illustrated in FIG. 8, along the guard 12. The size is indicated by the numeral that appears nearest the point where the heel of the lower component 2 meets the outsole 1. See the location identified by reference character 6A of FIG. 7. In another embodiment the size indicators appear on a top surface of the guard 12 of the outsole 1. In this embodiment, as the shoe size is increased, the smaller size indicators are obscured as the lower component 2 is expanded and moves along the outsole 1, with the first exposed numeral indicating the current shoe size.

The outsole 1, may be made of durable, waterproof, and slip resistant material typically used for the manufacturing of footwear soles (such as polyurethane or the like) and can be manufactured (such as injection molded, compression molded, dip molded, heat shrink molded, thermoformed, rotocasted, or vacuum molded) as a singular component or in conjunction with the lower segment 2.

A second embodiment comprises a lower component 40 (see FIG. 9) that mates with an outsole 44. In this second embodiment, the lower component 40 comprises horizontally-oriented interference pins 16 located on external side surfaces of a track section 42A. These pins 16 are captured within openings 17 in a second embodiment of an outsole 44, illustrated in FIG. 10. The openings 17 are defined within the heel guard 18 of the outsole 44.

Figure 9:
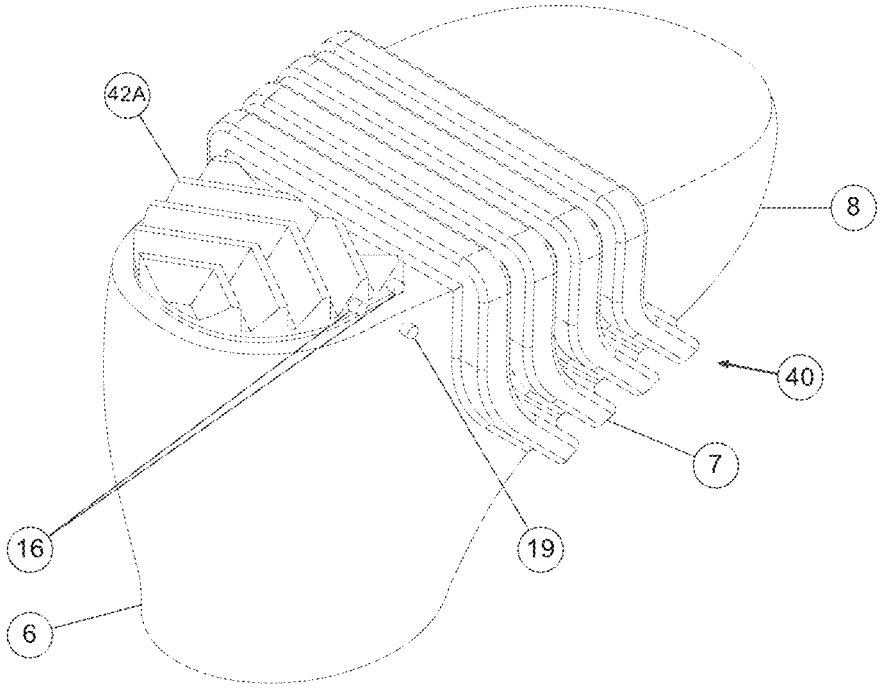
FIG. 9 is an underside view of the lower component of yet another embodiment of the invention.
Figure 10:
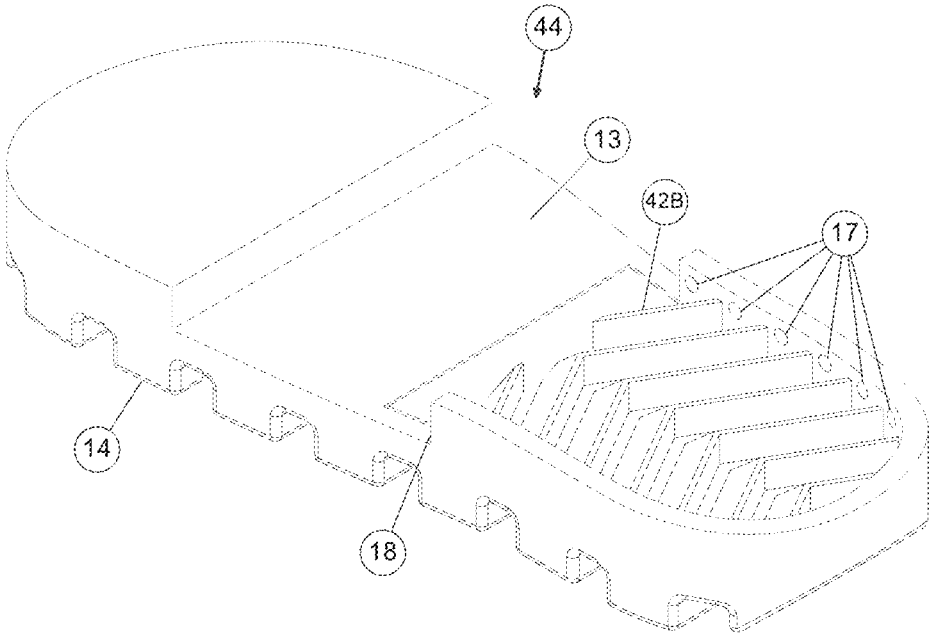
FIG. 10 is a top view of the outsole that mates with the lower component of FIG. 9.

A trigger mechanism 19 (such as a button or retractor), illustrated in FIG. 9, located on a side of the lower component 40 within the back heel section 6 is pushed to retract the horizontally-oriented interference pins 16, thereby disengaging the interference pins 16 from the openings 17, separating the lower component 2 and the outsole 1 so that the lower component 2 can be adjusted to a new length or shoe size.

After the adjustment has been completed, the horizontal interference pins 16 are then protracted again by releasing the trigger mechanism 19 to interlock the pins 16 within the openings 17.

Note that the track section 42B of the outsole 44 is different from the track section 9B in the outsole 1 depicted in FIG. 5. The track section 42B lacks the channels that are engaged with pins extending from the lower section 42B. Since the pin capture technique is not used in this embodiment, the channels are unnecessary.

As in the initial embodiment described above, when the lower component 40 is brought into contact with the outsole 44, the track sections 42A and 42B nest to prevent longitudinal movement of the lower component 40 relative to the outsole 44, and the pins 16 engage the holes 17 to vertically lock the lower component 40 to the outsole 44.

Figure 11:
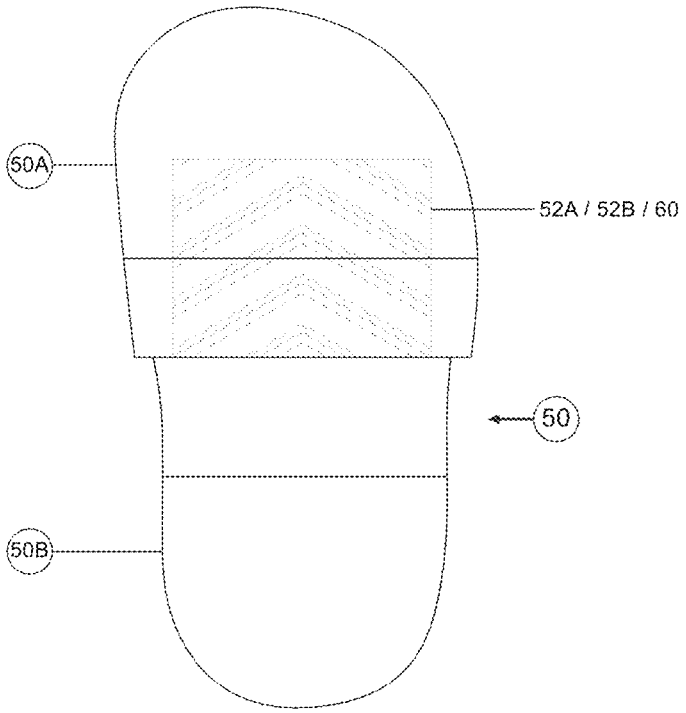
FIG. 11 is a top view of an outsole according to yet another embodiment of the invention.

In a third embodiment, FIG. 11 illustrates a top view of an outsole 50 segregated into two components, the front/toe (female) component 50A and back/heel (male) component 50B.

Figure 12:
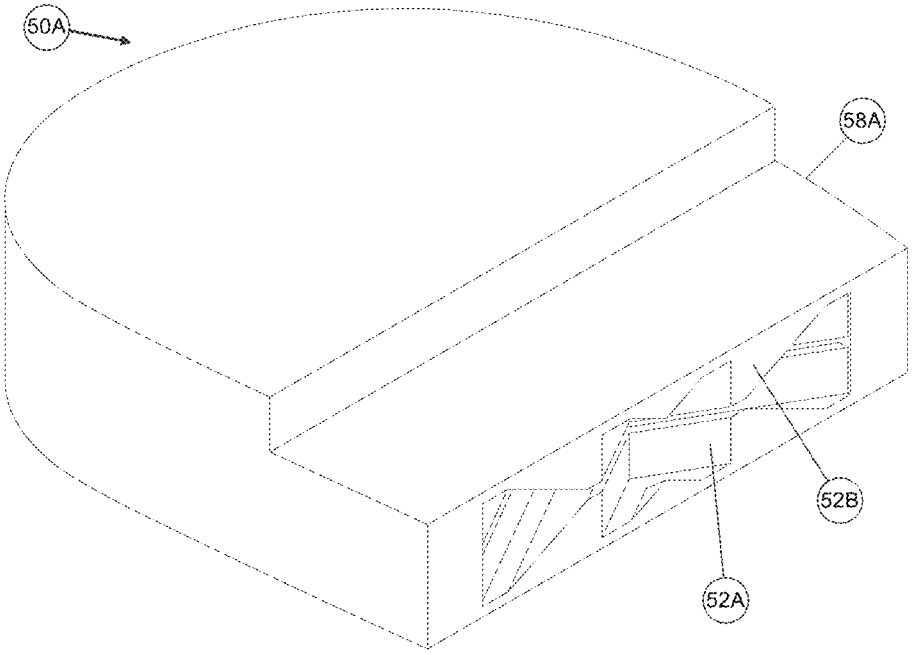
FIG. 12 is a perspective detailed view of a front segment of the outsole of FIG. 11.

The front/toe component 50A, further illustrated in FIG. 12, defines a cavity with track sections 52A and 52B on respective bottom and top internal surfaces of the cavity. Both track section 52A and 52B retain the herringbone (arrow) shaped profile with teeth protruding at an angle and pointing in the direction of a user's heel. In one preferred embodiment, the patterns formed on the track sections 52A and 52B are the same but mirrored on the two opposing internal surfaces of the cavity. With reference to FIG. 13A, the projection 60 is disposed between the track section 52A and 52B when the front/toe (female) component 50A and back/heel (male) component 50B are mated.

The back/heel (male) component 50B, illustrated in FIG. 13A, features herringbone patterns on both a top and bottom surface of the projection 60 (only the top surface shown in FIG. 13). As shown in FIG. 13B, the herringbone pattern comprises planar vertical surfaces 62AA toward the toe side of the back/heel (male) component 50B and planar angled surfaces 62AAA toward the heel side of the back/heel (male) component 50B.

FIG. 12 depicts a notch 58A on the front/toe component 50A for aligning with a notch 58B on the back/heel component 50B, thereby creating a continuous depression in the outsole 50. As can be seen in the side cross sectional view of FIG. 14, the bellows 7 extend into this depression.

Additionally, FIG. 14 illustrates the lower component 6 as attached to the outsole 50.

The front/toe component 50A and back/heel component 50B of the outsole 50 may be made of durable, flexible (such as a material with a high Poisson's ratio), waterproof, and slip resistant material typically used for the manufacturing of footwear soles (such as polyurethane or the like) and can be manufactured (such as injection molded, compression molded, dip molded, heat shrink molded, thermoformed, rotocasted, or vacuum molded) as a singular component or in conjunction with the lower component 66.

In this third embodiment, the bottom surface of the lower component 66 is flat. See FIG. 14. This flat surface is permanently joined (such as with an adhesive or via an over-molding process) to the top surfaces of both the front (female) component 50A and back (male) component 50B.

To change the shoe size, the user applies a force on both lateral (left-right) surfaces of the front (female) component 50A, in the area of the track sections 52A and 52B to vertically deform the track sections and thereby disengage the front/toe (female) component 50A and the back (male) component 50B. This deformed state allows the shoe lower component 66 to be pulled in the longitudinal direction to a different shoe size. Note that as the lower component 66 is stretched in the longitudinal direction to the desired length, the mid bellows section 7 accommodates expansion to a new shoe size (both longitudinally and vertically). Then when the force is released the track sections 52A, 52B, and 60 re-engage and lock the lower component 66 at a new length or shoe size.

Note that the vertical expansion of the bellows 7 (and thus vertical expansion the shoe lower component 2 (in any of the presented embodiments) is accommodated by a horizontal force component applied to the non-vertical segment of the bellows 7.

With reference to FIG. 11, the track sections 52A, 52B, and 60 are shown in phantom in the engaged state.

Figure 15:
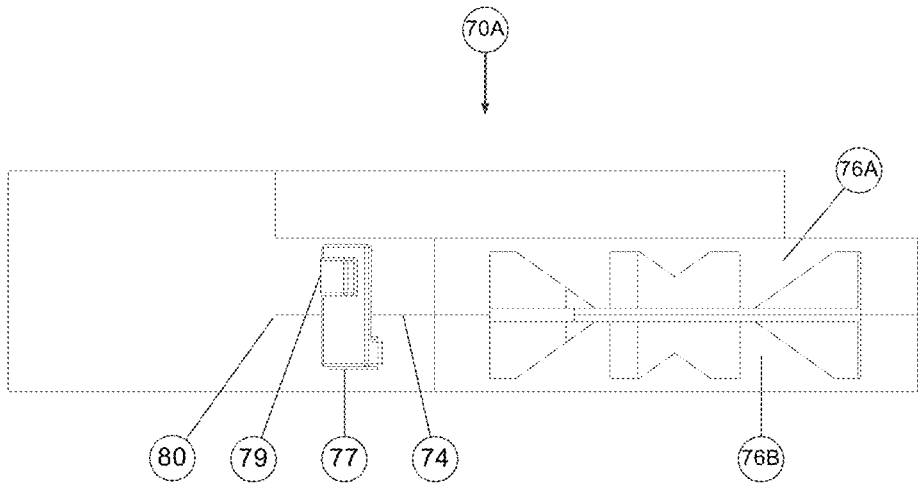
FIG. 15 is a side view of one front segment of the outsole according to yet another embodiment of the invention.
Figure 16:
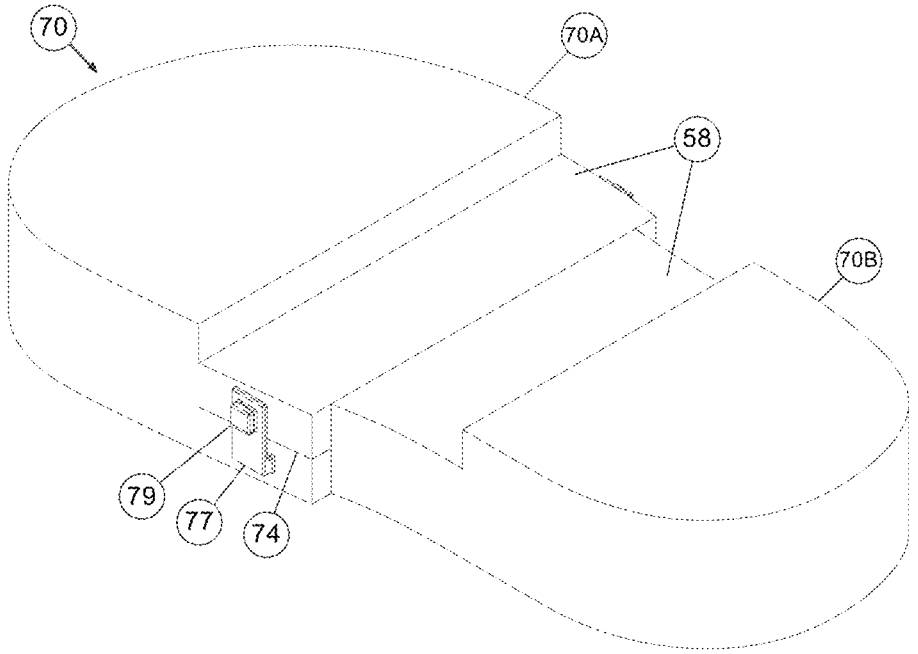
FIG. 16 is a perspective view of a complete outsole, a segment of which is depicted in FIG. 15.

In another embodiment (see FIGS. 15 and 16) the front/toe (female) component 70A (of an outsole 70 depicted in FIG. 16) is divided into two halves along a lateral split line 74. The herringbone track section is thereby split into two sections 76A (upper) and 76B (lower) as shown in FIG. 15.

A latch 77 located on both sides (right-left) of either the upper 76A or lower 76B section of the front/toe component 70A engages with pins 79 located on the other of the upper 76A or lower 76B section. The upper and lower track sections are joined at a hinge joint in a region identified by reference character 80 in FIG. 15. Thus the upper and lower sections of the front/toe component 70A are hingedly separated so as to receive the rear/heel component 70B.

According to this embodiment, the outsole 70 is split into two components, the front (female) component 70A described above in conjunction with FIG. 15 and back/heel (male) component 70B. The latch 77 can be disengaged to allow the top and bottom half of the track sections 76A and 76B to separate. This opened configuration allows the back/heel (male) component 70B and the lower component 2 of the shoe (not shown in FIG. 16) to be pulled in the longitudinal direction to expand the inventive footwear to a larger (or smaller) shoe size. After adjustment to a new shoe size, the latches 77 are re-engaged to lock the front/toe (female) component 70A and back/heel (male) component 70B together.

Preferably, the back/heel (male) component 70B in the outsole 70 (FIG. 16) is identical to the back/heel (male) component 50B in the outsole 50 (FIG. 13).

Figure 17:
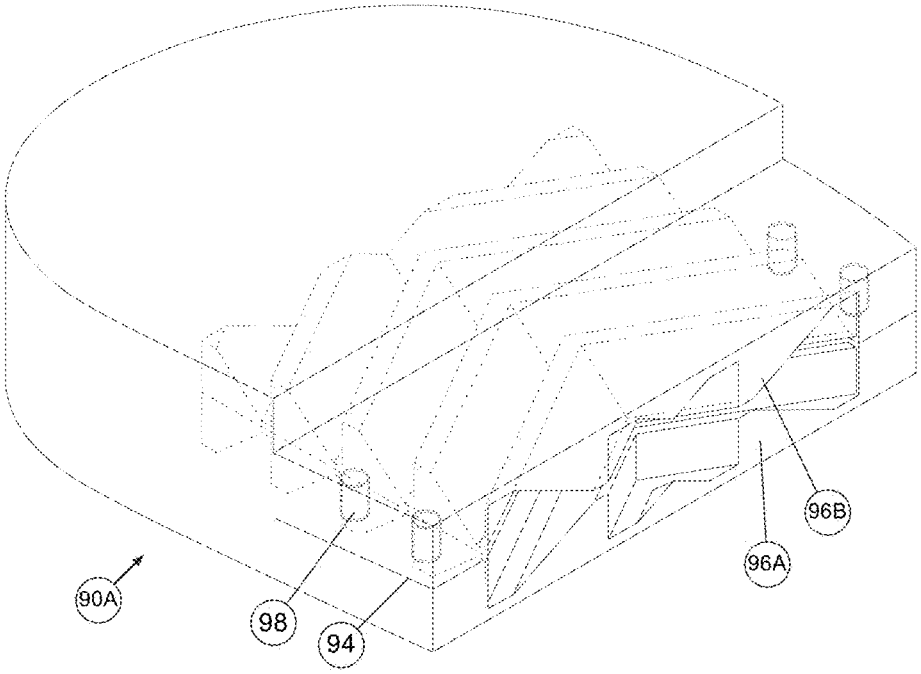
FIG. 17 is a perspective view of one front segment of an outsole according to another embodiment of the invention.
Figure 18:
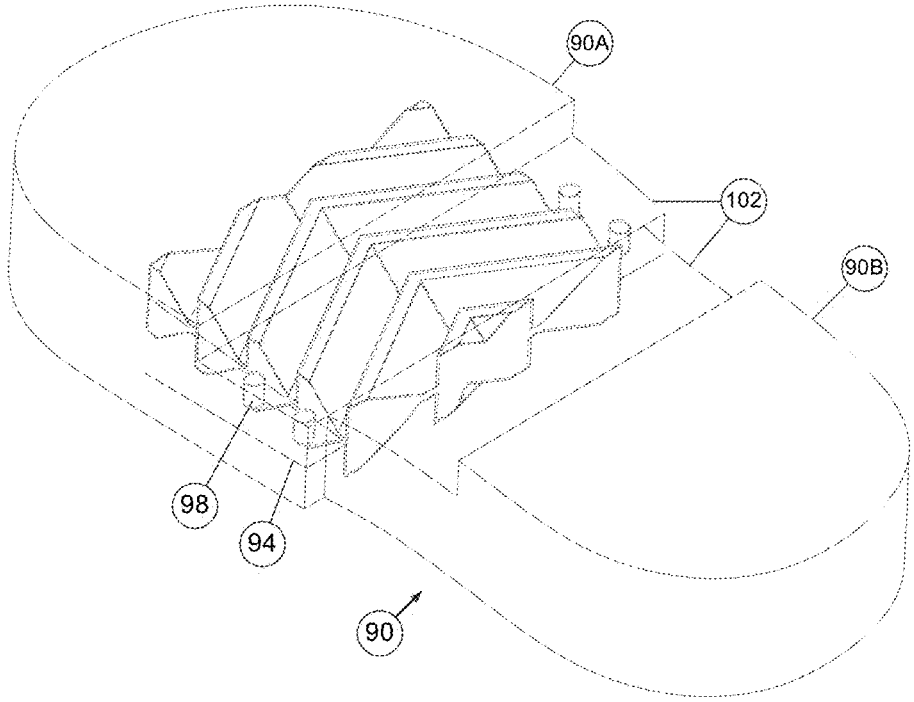
FIG. 18 is a perspective view of a complete outsole, a segment of which is depicted in FIG. 17.

In yet another embodiment, illustrated in FIGS. 17 and 18, an outsole 90 comprises two separable sections, that is, a front/toc (female) section 90A and a rear/heel (male) section 90B. The front/toe section 90A defines a lateral split along a line 94 separating the front/toe section 90A into two halves 96A and 96B. Vertical interference pins 98 (shown in phantom in FIG. 17) located on one of the two halves 96A and 96B engage openings (not visible in FIG. 17) defined in the other of the two halves to lock the two halves 96A and 96B together.

Herringbone profile triangular prisms are disposed on the inside facing surfaces of both the halves 96A and 96B. See FIG. 17. A similar herringbone profile of triangular prisms is disposed on both top and bottom surfaces of a protruding region of the rear/heel (male) section 90B, such as the track section 60 in FIG. 13. When the front/toe section 90A is matted with the rear/heel section 90B the herringbone patterns on the two sections engage.

With reference to FIG. 18, the two sections 90A and 90B are shown in an engaged state. Disengaging the pins 98 from their openings in the opposing section allows the top and bottom halves 96A and 96B to separate and permits removal of the back/heel section 90B.

Preferably, the back/heel (male) component 90B in the outsole 90 (FIG. 18) is identical to the back/heel (male) component 50B in the outsole 50 (FIG. 13).

As in other embodiments, with the outsole sections 90A and 90B separated, the longitudinal length of the footwear can be adjusted to either increase or decrease the shoe size. After this size adjustment, the vertical interference pins 98 are reinserted into their respective openings to lock the front female component 90A and the back male component 90B together in the vertical direction.

When engaged, the front female and back male components 90A and 90B define a notch 102 as illustrated in FIG. 18.

Within the various described embodiments, the inner lining 3 (see FIG. 1) is joined to the upper component 4 such as with a combination of an adhesive and stitching before the upper tightening mechanism 5 (such as a drawstring and cord lock) is fitted into the upper component 4. The top side of the upper component 4 is folded in and stitched to itself.

The inner lining 3 may be made of durable, stretchable, breathable, and thermally insulating material typically used for the manufacturing of winter footwear (such as fleece, wool, GoreTex® material (GoreTex® is a registered trademark of W. L. Gore and Associates, Inc.), Thinsulate™ material (Thinsulate™ is a trademark of 3M Company), or the like) and can be manufactured by textile manufacturing and stitching or the like.

The material of the inner lining 3 features pleats or folds to reduce bulk while providing for additional material as the boot increases in size. In one embodiment, the lining is folded to retain a geometric tesselation pattern to unfold and expand in both longitudinal and vertical directions. In another, the material is folded to hold an accordion-like pattern that expands longitudinally. In both embodiments, the added bulk from the folds in the smaller sizes functions as cushioning and filler to hold the foot in place.

The upper tightening mechanism 5, such as a Velcro® brand strap, (Velcro® is a registered trademark of Velcro IP Holdings, LLC), may also be stitched to the outer side of the upper component 4 after the inner lining 3 has been attached.

All the various embodiments of the lower component 2 are joined (such as with a combination of an adhesive and stitching or via over-molding) to the bottom surface of the upper component 4 (FIG. 1) such that there is overlapping material between the lower component 2 and upper component 4 to prevent foreign objects or external elements from entering through this seam.

The upper component 4 may be made of durable, thermally insulating, and waterproof material typically used for the manufacturing of footwear upper components (such as nylon or the like) and can be manufactured by textile manufacturing and stitching or the like.

A length of the lower component 2 in the various embodiments (with the bellows in a normal or unexpanded state) is selected at the smallest shoe size the invention is designed to accommodate. The outsole 1 (that is, components of the outsole in the various embodiments) are longer (three shoe sizes longer in one embodiment). This length differential is depicted in FIG. 7 with the outsole 1 extending beyond the back heel section 6A of the lower component 2. For the embodiments that comprise a split outsole, the length of the opening and the length of the protrusion are determined to accommodate a range of shoe sizes.

The width of both the lower component 2 and the outsole 1 is selected at the width of the largest shoe size that can be accommodated. The inner lining (reference numeral 3 in FIG. 1) can allow for the difference in width between the user's foot and the footwear when the lower component 2 is set at its smallest size.

Shoes or snow boots constructed according to the teachings of the invention are available in four size ranges, referred to as small, medium, large, and extra-large. Each size range spans four shoe sizes, equivalent to about a one-inch difference in length.

Bottom tread patterns on the outsole component 1, as shown in FIGS. 1 and 2, for example, are also present on the split outsole embodiments illustrated in FIGS. 12, 13A, 16, 17, and 18, although not depicted in those latter figures.

The various illustrated embodiments each emphasize certain specific features of the various components that differ from other embodiments. It is understood that these embodiments necessarily include other elements of the invention that have been described in the context of other embodiments. Also, references to shoe, boot, footwear, and snow boot are used interchangeably herein.

In the various embodiments comprising a split outsole (FIGS. 11-18) both segments of the split outsole are bonded permanently to the lower component (the toe and heel regions of the lower component). Thus, when the two segments of the outsole are separated, the lower component can be adjusted longitudinally and vertically to a new shoe size.

What is claimed is:

1. An expandable article of foolwear, comprising:

a lower component having a toe region and a heel region, and an expandable and contractable region betwee the toe region and the heel region;

an upper component extending upwardly from the heel region;

an oulsole;

a plurality of first capture elements disposed in the lower component;

a plurality of complementary second capture elements disposed in the outsole;

the plurality of first capture elements and the plurality of second capture elements engaged to removably attach the outsole and the lower component preventing a change in a dimension of the expandable and contractible region;

wherein separation of the outsole from the lower component places the plurality of the first and second capture elements in a disengaged state, allowing a change in a dimension of the expandable and contractable region;

wherein the plurality of first capture elements comprises a plurality of spaced apart triangular prisms extending downwardly from a bottom surface of the lower component and one or more pins extending downwardly from the bottom surface of the lower component;

wherein the plurality of complementary second capture elements comprises a plurality of complementary spaced apart triangular prisms extending upwardly from a top surface of the outsole and one or more openings defined in the top surface of the outsole; and wherein the one or more pins engage the one or more openings to removably attach the outsole to the lower component.

2. The expandable footwear of claim 1, wherein the change in a dimension of the expandable and contractable region comprises expanding or contracting the expandable and contractable region in one or both of a longitudinal direction and a vertical direction.

3. The expandable footwear of claim 1, wherein the expandable and contractable region comprises a plurality of bellows.

4. The expandable footwear of claim 3, wherein a region of the plurality of bellows extends beyond the lower surface of the lower component, and wherein the outsole defines a notch for receiving the region of the plurality bellows.

5. The expandable footwear of claim 1, wherein the one or more openings comprise one or more channels, and wherein a top region of each one of the one or more pins defines a dome-shaped top region.

6. The expandable footwear of claim 1, wherein each one of the triangular prisms comprise a right-angle prism.

7. The expandable footwear of claim 1, wherein the upper and lower components and the outsole are joined or integrated to maintain watertight and thermal insulation properties.

8. The expandable footwear of claim 1, wherein the plurality of first and second capture elements comprise a herringbone pattern, wherein the herringbone pattern aligns the lower component and the outsole when the plurality of first capture elements and the plurality of second capture elements are engaged.

9. The expandable footwear of claim 1, wherein a lower surface of the outsole comprises a slip-resistant surface for improving traction on icy or slippery surfaces.

10. The expandable footwear of claim 1, wherein the footwear comprises a shoe or a boot.

11. The expandable footwear of claim 1, further comprising a fastener for drawing the upper member tightly around a wearer's ankle.

12. The expandable footwear of claim 1, further comprising size indicators disposed on an externally facing heel region of the outsole.

* * * * *